United States Patent [19]

Davis

[11] Patent Number: 4,776,752

[45] Date of Patent: Oct. 11, 1988

[54] SPEED GOVERNED ROTARY DEVICE

[76] Inventor: Lynn M. Davis, 1354 NW. 4th St., Boca Raton, Fla. 33432

[21] Appl. No.: 21,273

[22] Filed: Mar. 2, 1987

[51] Int. Cl.[4] ..... F01B 25/06

[52] U.S. Cl. ..... 415/25; 415/82; 415/202; 137/625.28; 137/625.3; 251/900

[58] Field of Search ..... 415/25, 80, 82, 202; 137/625.28, 625.3, 57; 251/900

[56] References Cited

U.S. PATENT DOCUMENTS

| | | | |
|---|---|---|---|
| 2,473,948 | 6/1949 | Harstick | 137/56 |
| 2,473,967 | 6/1949 | Orelind | 137/56 |
| 2,635,617 | 4/1953 | Condell | 137/56 |
| 2,674,254 | 4/1954 | Tregillus | 137/56 |
| 3,326,195 | 6/1967 | Pezz | 137/56 |
| 3,578,872 | 5/1971 | McBurnie | 415/25 |
| 3,708,240 | 1/1973 | Theis | 415/25 |
| 3,802,515 | 4/1974 | Flamond | 415/25 |
| 4,087,198 | 5/1978 | Theis | 415/25 |
| 4,090,821 | 5/1978 | Barrows et al. | 418/41 |
| 4,529,354 | 7/1985 | Klepesch | 415/202 |
| 4,543,038 | 9/1985 | Kitaguchi | 417/406 |
| 4,641,498 | 2/1987 | Markovitch et al. | 415/202 |

*Primary Examiner*—Larry I. Schwartz
*Attorney, Agent, or Firm*—Jack N. McCarthy

[57] ABSTRACT

A governor device for controlling the speed of rotary devices is disclosed. The governor device is a valve operated by centrifugal force to control a pressurized fluid through the nozzles of a turbine rotor. The valve comprises a rotary chamber having an opening outwardly of a resilient valve member therein, the resilient valve member being movable by centrifugal force to control flow through said annular chamber, said annular chamber being part of the passageway of the pressurized fluid flow through said turbine rotor nozzles.

34 Claims, 2 Drawing Sheets

SPEED GOVERNED ROTARY DEVICE

DESCRIPTION

1. Technical Field

This invention relates to centrifugally operated rotary devices for controlling the flow of a pressurized fluid therethrough, and especially to its use in a turbine rotor for controlling the rotary speed of the turbine rotor.

2. Background Art

While governors for rotary devices are well known in the art, no device could be formed which anticipated the combination of the present invention. The most pertinent prior art of which applicant is aware consists of the following: U. S. Pat. Nos. 4,087,198; 3,708,240; 4,090,821; 3,326,195; 4,543,038; 2,473,948; 2,473,967; 2,674,254; and 2,635,617.

3. Disclosure of Invention

An object of this invention is to provide a rotor having a valve device which controls the flow of a pressurized fluid through the rotor in accordance with centrifugal force resulting from the speed of the rotor.

Another object of this invention is to provide a simple, economical and fail-safe centrifugally operated valve device which can perform the function of an overspeed governor. The device can be constructed to provide very sensitive governing actions.

A further object of this invention is to provide a centrifugally operated valve device operating as an overspeed governor that is less complex, less costly, more reliable, and having predictable failure modes that cause lower rotary speed, thereby providing safer overspeed governing operation. With proper construction and choice of materials, this valve device will have no dangerous failure modes.

Another object of this invention is to provide an overspeed governor whereby sensitivity of governing action can be controlled so as to make the governing action take place over a desired span of rotary speed.

A further object of the invention is to provide an overspeed governor that is not affected by contaminants in a pressurized fluid supply. Particulate contaminants will not greatly affect governing actions because of the ability of the elastic material to physically deform around them.

A further object of this invention is to provide a rotary device actuated by pressurized fluid where the governor is capable of relatively precise speed control and also is capable of fully shutting off the pressurized fluid if for any reason the rotary device exceeds a desired speed.

Another object of this invention is to provide a rotatable enclosure having a passage for pressurized fluid, said passage having an inlet and outlet for conducting the pressurized fluid through the device, valve means in said passage, said valve means having a resilient valve member for controlling pressurized flow through said passage, movement of said valve member being controlled by centrifugal force.

BEST MODE FOR CARRYING OUT THE INVENTION

Figure 1:
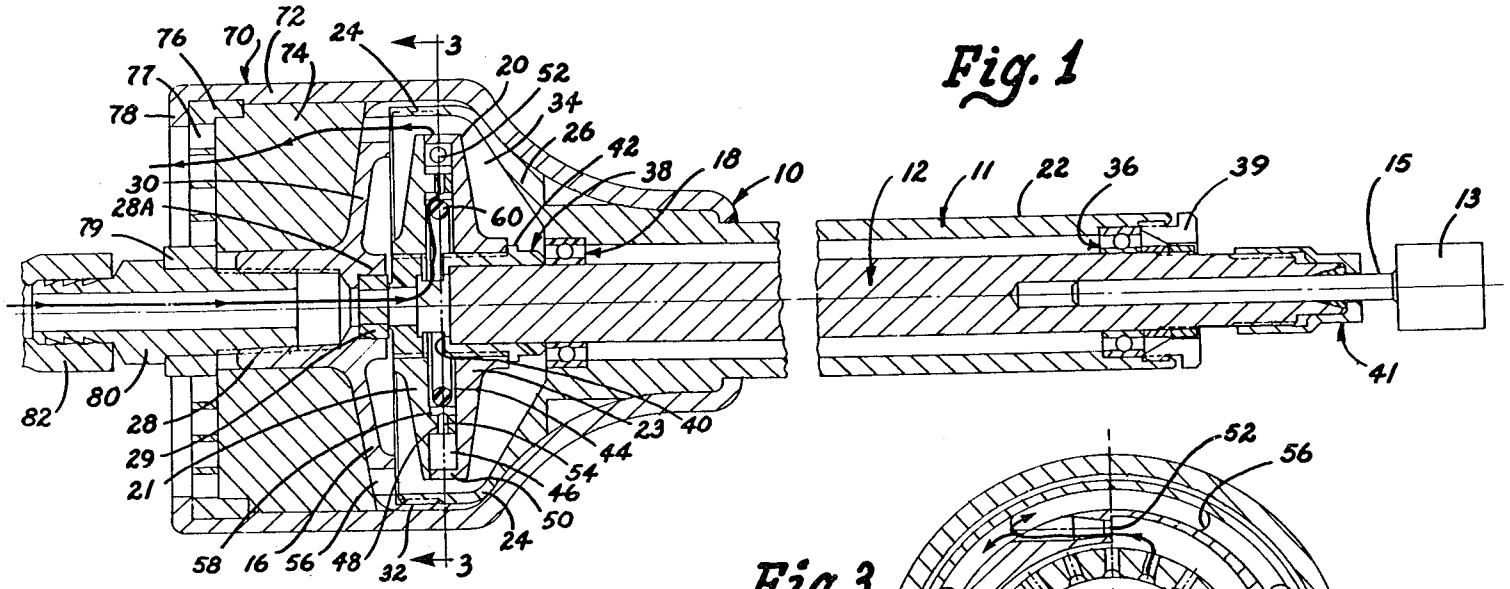
FIG. 1 is a cross-sectional side view of a hand-held, high speed, turbine driven rotary grinder showing one embodiment of the invention.
Figure 3:
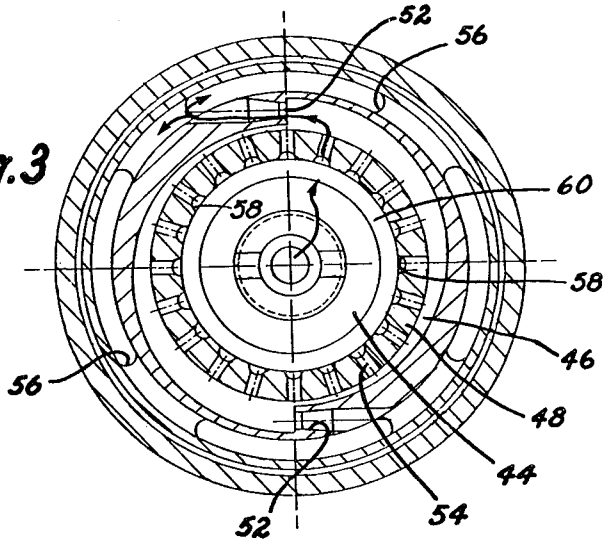
FIG. 3 is a view taken along the line 3—3 of FIG. 1 showing the centrifugally operated valve in a position where the resilient valve ring is unaffected by centrifugal force.
Figure 4:
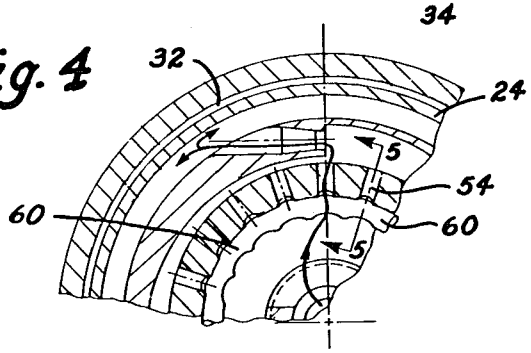
FIG. 4 is a fragmentary view of a portion of FIG. 3 showing the centrifugally operated valve in a position where the resilient valve ring is affected by centrifugal force and positioned to control fluid flow.

In the embodiment shown in FIGS. 1, 3, 4 and 5, the rotary device 10 comprises four main parts:

(1) an elongated forward housing 11;
(2) a rearward housing 16;
(3) a rotatable drive shaft means 12; and
(4) a turbine rotor 20.

The elongated forward housing 11 comprises a long cylindrical forward part 22 with a short enlarged cylindrical section 24 fixed to the rearward end thereof by an outwardly extending conical flange portion 26. The rearward housing 16 has a short cylindrical pressurized fluid inlet portion 28 with an outwardly extending flange portion 30 fixed adjacent the forward end thereof. The forward end has a fixed sealing ring 29 set therein for a purpose to be hereinafter described. The outer edge of the flange portion 30 has a forwardly extending cylindrical flange 32 which is formed to mate with the outer surface of cylindrical section 24. The outer surface of cylindrical section 24 is formed with external threads and the inner surface of cylindrical flange 32 is formed with internal threads which engage each other to fix the rearward housing 16 to the elongated forward housing 11, an enlarged cylindrical chamber 34 being formed therebetween.

Rotatable drive shaft means 12 is rotatably mounted in the elongated forward housing 11 by a rearward ball bearing assembly 18 and a forward ball bearing assembly 36. Each outer race of each ball bearing assembly 18 and 36 is positioned in an annular countersunk portion in each end of the long cylindrical forward part 22 of the elongated forward housing 11 while each inner race is positioned on said rotatable drive shaft means 12. The rotatable drive shaft means 12 has its rearward end projecting into said enlarged circular chamber 34 and has a turbine rotor coupler 38 affixed thereto. The forward end of the turbine rotor coupler 38 contacts the end of the inner race of the rearward ball bearing assembly 18, and a holding unit 39 is threaded into the front end of the long cylindrical forward part 22 to contact the outer race of the forward ball bearing assembly 36 to hold it in place. Sealing means are located between said holding nut 39 and said rotatable drive shaft means 12. The turbine rotor coupler 38 is formed as a cylindrical member having a first forward bore portion adapted to fit over and receive the rearward end of the rotatable drive shaft means 12, a second midpoint counterbore portion, and a third rear counterbore portion extending through to the rear of the turbine rotor coupler 38. The second midpoint counterbore portion has diametrically opposed radial openings 40 therethrough to the exterior of the turbine rotor coupler 38. The rear of the turbine rotor coupler 38 has a rearwardly extending annular sealing flange around said third rear counterbore for sealing with the sealing ring 29 set in the forward end of short cylindrical portion 28A. This sealing arrangement provides for a flow of a pressurized fluid through the short cylindrical pressurized fluid inlet portion 28A into the turbine rotor coupler 38 to the diametrically opposed radial openings 40. The turbine rotor coupler 38 is externally threaded from its rearward end to a place adjacent its forward end where an annular shoulder 42 is formed.

Turbine rotor 20 has a central opening therethrough which is internally threaded to engage the external threads on the turbine rotor coupler 38. The turbine rotor 20 is formed of two halves, 21 and 23 fixed together, having a first annular chamber 44 extending radially outwardly from the threaded central opening therethrough and a second outer annular chamber 46. Said first and second annular chambers are separated by an annular wall 48 and have front and rear walls spaced apart. An outer wall 50 of the turbine rotor 20 is located at the outer periphery of the second outer annular chamber 46 and has two nozzles 52 therethrough which impart rotation to the rotor in a manner well known in the art (see U. S. Pat. Nos. 3,708,240 and 4,087,198). When the turbine rotor 20 is threadably mounted on the turbine rotor coupler 38, with its forward end against annular shoulder 42, the inner end of the first annular chamber 44 is open to the two diametrically opposed radial openings 40 to receive pressurized flow therefrom.

The annular wall 48 has a plurality of radial holes 54 connecting the first annular chamber 44 to the second outer annular chamber 46, and the flange portion 30 of the rearward housing 16 has a plurality of exit openings 56 therethrough to exhaust flow from the nozzles 52. The inward end of each of the radial holes 54 in the annular wall 48 has a semicircular groove 58 crossing it located axially on the inner surface of the annular wall 48. While each groove 58 is substantially semicircular in cross-section, other arcuate and contoured forms can be used to achieve desired results. A resilient valve ring 60 is positioned in said first annular chamber 44 with its outer circumference engaging the inner surface portions of the wall 48 between the grooves 58 with said front and rear walls of said first annular chamber 44 being spaced apart to allow pressurized fluid to flow past said resilient valve ring 60.

The rotatable drive shaft means 12 has its forward end projecting forwardly of the holding nut 39 and sealing means. This forward end includes means 41 for fixing rotary tools thereto. Many tool holding means well known in the art can be used if desired. A grinding wheel 13 is shown having a shaft 15 extending into the rotatable drive shaft 12 and being fixed in that position by fixing means 41.

A muffling housing 70 is placed over the enlarged cylindrical section 24 and outwardly extending conical flange portion 26 of elongated forward housing 11 and extends rearwardly as a cylindrical member 72 over rearward housing 16. Said cylindrical member 72 extends rearwardly to contain muffling material 74, such as felt. A rear holding plate 76 having openings 77 is placed in the rear of cylindrical member 72 to contain the muffling material 74 and the cylindrical member 72 is bent over having inwardly extending annular flange 78 contacting the outer periphery of the holding plate 76. The center of the holding plate 76 has a cylindrical boss 79 for receiving an inlet adapter 80. The inlet adapter 80 extends through the cylindrical boss 79 and threadably connects with internally threaded cylindrical pressurized fluid inlet portion 28 to hold the holding plate 76 in place. The muffling housing 70 can be formed as a rubber boot.

In operation, in the embodiment shown in FIGS. 1, 3, 4 and 5, the pressurized fluid flow path is directed into inlet adapter 80 from a flexible hose 82, through inlet adapter 80, connected cylindrical pressurized fluid inlet portion 28, and sealing ring 29 into the third rear counterbore at the rear of the turbine rotor coupler 38. The flow then goes radially outwardly from the second midpoint counterbore portion of the turbine rotor coupler 38 through the diametrically opposed radial openings 40. Here the pressurized flow passes out the first annular chamber 44 around resilient valve ring 60 and through grooves 58 to radial holes 54 into the second annular chamber 46 where it is directed through nozzles 52, thereby imparting rotation to the rotatable drive shaft means 12 and grinding wheel 13. The pressurized fluid then passes into cylindrical chamber 34 where it exits through exit opening 56, in outwardly extending flange portion 30 of rearward housing 16, into the muffling housing 70 where the exhaust noise is muffled, and the exhausted flow then exits through openings 77 through the rear holding plate 76 to atmosphere.

As a pressurized fluid, such as compressed air, is directed into inlet adapter 80 at a selected p.s.i., rotation increases to a preselected maximum; centrifugal forces acting on resilient valve ring 60 tend to cause radial expansion of said ring 60. However, the inner surface of the annular wall 48 supports valve ring 60, except at grooves 58. This enables the radial expansion of the valve ring 60 to be directed into the grooves 58 so as to cause a controlled elastic deformation of valve ring 60, as shown approximately in FIGS. 4 and 5. By this construction, flow can be essentially unrestricted until valve ring 60 comes into relatively close proximity to radial holes 54. By this construction, forces acting on the elastic material are of sufficient magnitude as to cause pressure differential between radial holes 54 and the first annular chamber 44 to be relatively insignificant to operation, allowing smooth operation.

In operation, as the resilient valve ring 60 deforms, it approaches the ends of radial holes 54. As the distance narrows sufficiently, fluid flow through the radial holes 54 is restricted and rotating forces reduced. As drag forces acting on the system and rotating forces reach equilibrium, the forces acting on the resilient valve ring 60, namely centrifugal forces, centripetal forces, pressure differential forces across the ring, and the resilient forces acting to return the elastic material to its original configuration, will also be in equilibrium. This results in a constant rotary speed. If drag forces increase, the equilibrium would be disrupted, and the resilient valve ring 60 resilient forces will retract the valve ring 60 from its clossest proximity to radial holes 54, allowing additional fluid flow until another equilibrium is established.

If for any reason the turbine should exceed the desired governed speed, the resilient valve ring 60 will move to restrict pressure fluid flow even further until sufficient overspeed will cause all flow to stop, thereby incorporating an overspeed safety.

Figure 2:
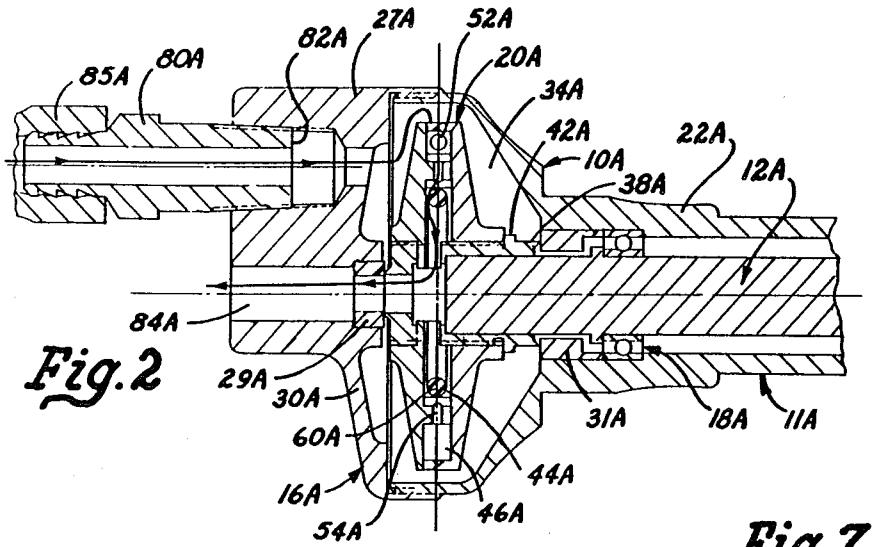
FIG. 2 is a fragmentary view of a second embodiment of the invention showing a cross-section of the turbine drive.
Figure 5:
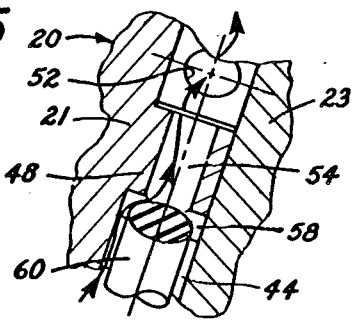
FIG. 5 is an enlarged view taken along the line 5—5 of FIG. 4 showing the resilient valve ring in a position under the effect of centrifugal force to control fluid flow through the turbine rotor.

In the embodiment shown in FIG. 2, the rotary device 10A comprises the same four main parts as the rotary device 10 of FIG. 1. As a matter of fact, the showings in FIGS. 3, 4 and 5 which are sections of FIG. 1, also hold for FIG. 2, except that rotary device 10A is illustrated without muffler housing cylindrical member 72. The difference in the two modifications is that the pressurized flow in FIG. 1 is radially outward and the pressurized flow in FIG. 2 is radially inward.

Rotary device 10A has a different rearward housing 16A with an enlarged portion 27A on said flange portion 30A for providing an offset pressurized fluid inlet passage 82A from its exterior to the enlarged cylindrical chamber 34A. An inlet adapter 80A is connected to the exterior end of inlet passage 82A. The turbine rotor coupler 38A is different from turbine rotor coupler 38 in that it has a sealing arrangement at the forward end similar to the sealing arrangement at the rearward end; an annular sealing flange extends from each end and mates with a sealing ring, 29A, at the rear and 31A at the front. Sealing ring 31A is mounted in the rearward end of the long cylindrical forward part 22A of forward housing 11A against the inner race of rearward ball bearing assembly 18A.

The rotor 20A is the same as turbine rotor 20 with the direction of pressurized fluid flow being the only difference in the two embodiments. This arrangement makes the third rear counterbore of the rotor coupler 38A the exit opening to the opening in the sealing ring 29A which is connected to outlet 84A.

In operation, in the embodiment shown in FIG. 2, a pressurized fluid flow path is directed into inlet adapter 80A from a flexible hose 85A; and through inlet adapter 80A into enlarged cylindrical chamber 34A. From chamber 34A, the flow then goes through nozzles 52A into the second annular chamber 46A where it is directed through radial holes 54A into the first annular chamber 44A; flow through the nozzles 52A may impart rotation to the rotatable drive shaft means 12A. The pressurized fluid then passes around resilient valve ring 60A into the diametrically opposed radial openings 40A and into the second midpoint counterbore portion of the turbine rotor coupler 38A where the flow is directed through the third rear counterbore through the sealing ring 29A into the outlet 84A of the rearward housing 16A. The elements of the embodiment shown in FIG. 2 react to rotation and centrifugal force in the same manner as the embodiment of FIG. 1.

Figure 6:
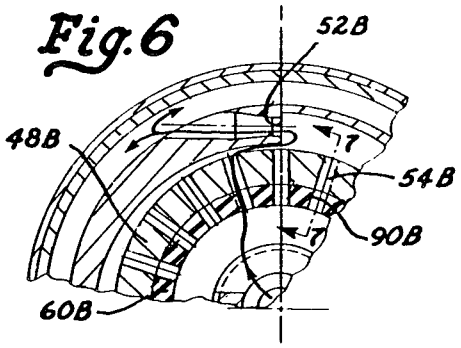
FIG. 6 is a fragmentary view, similar to FIG. 4, of another embodiment of the invention showing a modified resilient valve ring.
Figure 8:
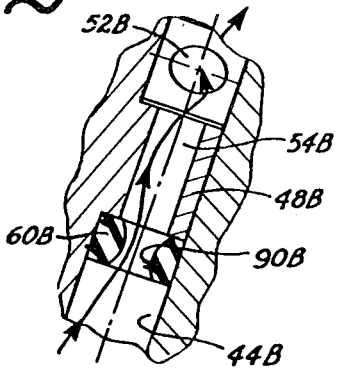
FIG. 8 is an enlarged view similar to FIG. 7 showing the modified resilient valve ring in a position under the effect of centrifugal force to control fluid flow through the turbine rotor.
Figure 7:
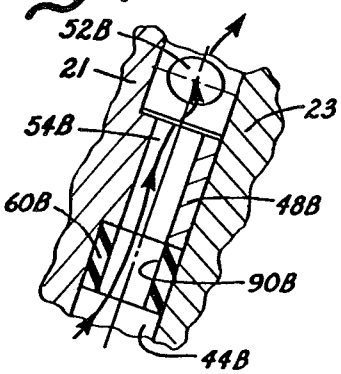
FIG. 7 is an enlarged view taken along the line 7—7 of FIG. 6 showing the modified resilient valve ring in a position unaffected by centrifugal force.

In the embodiment shown in FIGS. 6, 7 and 8, the difference is in the resilient valve ring 60B which is of a rectangular cross-section (see FIG. 7) and is positioned in the outer periphery of the first annular chamber 44B with its side walls contacting the front and rear walls of the first annular chamber 44B and with its outer cylindrical surface engaging the cylindrical inner surface of the wall 48B. Resilient valve ring 60B has radial holes 90B, one aligned with each radial hole 54B in the annular wall 48B. Resilient valve ring 60B is acted on by centrifugal force in the same manner as resilient valve ring 60; however, in this embodiment, the deformation is controlled so as to cause the radial holes 90B to narrow, thereby restricting fluid flow therethrough (see FIG. 8). The flow of pressurized fluid remains the same as that described above for the embodiments of FIGS. 1 and 2 in the event resilient valve ring 60B is used.

Certain characteristics of this valve device are particularly desirable when it is used as an overspeed governor. Because pressure fluid force influences are relatively minor in the preferred embodiments, the governor will not readily respond to supply pressure fluctuations, but will maintain an essentially stable speed over a wide pressure range.

In construction, the resilient valve ring 60 is large enough to prevent movement through radial holes 54 even if resilient valve ring 60 breaks, thus preventing overspeed in this event.

Wear on contact areas of resilient valve ring 60 will allow easier movement of valve ring toward passages, thereby reducing rotary speed, providing slow failure mode and reduced rotary speed.

By choosing materials for resilient valve ring 60 that will avoid chemical decomposition, there are no failure modes that would allow dangerous overspeed. With proper materials, decomposition would result in a softer material with less resilient forces, thereby lowering rotary speed.

If one visualizes turbine rotor 20 including annular chambers 44 and 46 to be made of two-piece molded construction, it is apparent that by inserting the resilient valve ring 60 and then joining the two pieces, a very inexpensive, safe, and reliable motor and overspeed governor would be obtained. Although a continuous resilient sealing ring 60 has been shown, ring segments can be used.

It is obvious that this is a useful centrifugally operated valve device that is especially useful when utilized as an overspeed governor.

Although I have described the invention fully in connection with the preferred embodiments, it should be obvious to one skilled in the art that numerous modifications are possible, and I do not wish to be limited to the scope of my invention except by the scope of the following claims.

I claim:

1. A speed governed rotary device comprising a turbine rotor having an axis of rotation, means for mounting said turbine rotor for rotation about said axis of rotation, said turbine rotor having a first radially extending chamber means therein, means for directing a pressurized fluid into said first radially extending chamber means, said turbine rotor having a second chamber means located adjacent said first chamber means, a wall being located between said first chamber means and said second chamber means, nozzle means connecting the interior of said second chamber means to the exterior of said second chamber for directing a pressurized fluid therefrom to impart rotation to said turbine rotor, said wall having opening means therein connecting said first chamber means to said second chamber means for carrying a pressurized fluid therebetween, resilient sealing means located in said first chamber means, said first chamber means having surface means radially outward of said resilient sealing means for engagement by said sealing means, said resilient sealing means being movable outwardly by centrifugal force to restrict pressurized flow through said opening means, said sealing means being operable by centrifugal force to elastically deform its configuration by being forced radially against said radially outward surface means to restrict or close fluid flow through said opening means.

2. A combination as set forth in claim 1 wherein said resilient sealing means is not fixedly connected to said first chamber means.

3. A combination as set forth in claim 2 wherein said resilient sealing means is an annular member of resilient material.

4. A combination as set forth in claim 1 wherein said opening means has a contoured connection to said surface means of said first chamber means to control the restriction of flow by the movement of said resilient sealing means as it deforms elastically into said contoured connection.

5. A combination as set forth in claim 1 wherein said opening means includes a plurality of openings extending through said first wall between said first chamber means and said second chamber means, said surface means controlling movement of said resilient sealing means outwardly to restrict or close fluid flow through said openings.

6. A combination as set forth in claim 5 wherein said openings are radial, said surface means for controlling movement of said resilient sealing means comprising a contoured connection to said radial openings of said first chamber means for engaging said resilient sealing means as it expands outwardly and controlling its movement to restrict pressurized flow through said radial openings.

7. A combination as set forth in claim 1 wherein said openings are radial, said first chamber means has side walls spaced apart to allow pressurized fluid to flow unrestricted by said resilient sealing means until said resilient sealing means has been moved outwardly by centrifugal force to restrict or close pressurized flow through said radial opening means.

8. A combination as set forth in claim 1 wherein said radially outward surface means provides for positioning all of said resilient sealing means radially during operation after initial contact of said radially outward surface means by said resilient sealing means.

9. A combination as set forth in claim 1 wherein all positive limitations of outward movement of said resilient sealing means are provided by surface contact with said first chamber means including said radially outward surface means.

10. A combination as set forth in claim 1 wherein the structure of said first chamber means and said resilient sealing means maintains the location of said sealing means in an operating position to control flow through said opening means even though said resilient sealing means is broken through.

11. A combination as set forth in claim 10 wherein said resilient sealing means is annular, the structure of said chamber and said annular sealing means maintains the location of said annular sealing means to control flow through said opening means even though said annular sealing means has a break therein.

12. A combination as set forth in claim 1 wherein said opening means is a plurality of holes in said wall, said surface means being constructed to have a separate contoured form for each hole, each separate contoured form controlling the shape of said sealing means deformation for controlling flow through each hole.

13. A combination as set forth in claim 1 wherein said surface means controls the movement of said resilient sealing means as it deforms elastically.

14. A combination as set forth in claim 3 wherein said annular member of resilient material has opening means therethrough aligned with said wall opening means.

15. A combination as set forth in claim 1 wherein said sealing means is elastically deformed to move radially towards said opening means to restrict or close fluid flow through said opening means.

16. A combination as set forth in claim 1 wherein said resilient sealing means is annular, said annular sealing means being positioned against said surface means of said first chamber means, said annular sealing means having opening means therethrough aligned with said opening means in said wall, said annular sealing means when moved outwardly by centrifugal force deforms the annular sealing means to restrict flow through said opening means in said wall.

17. A combination as set forth in claim 16 wherein said opening means in said wall includes a plurality of openings extending through said wall between said first chamber means and said second chamber means, said opening means in said annular sealing means including a plurality of openings extending therethrough aligned with said openings in said wall, said annular sealing means when moved outwardly by centrifugal force deforms the annular sealing means to restrict flow through said openings in said wall.

18. A combination as set forth in claim 17 wherein said openings in said wall extend in a radial direction.

19. A speed governed rotary device comprising a turbine rotor having an axis of rotation, means for mounting said turbine rotor for rotation about said axis of rotation, said turbine rotor having a first radially extending chamber means therein, means for directing a pressurized fluid into said first radially extending chamber means, said turbine rotor having a second chamber means located radially outwardly of said first chamber means, a first wall being located between said first chamber means and said second chamber means, said second chamber means having an outer second wall, nozzle means in said outer second wall connecting said second chamber means to the exterior of said outer second wall for directing a pressurized fluid therefrom to impart rotation to said turbine rotor, said first wall having radial opening means therein connecting said first chamber means to said second chamber means for carrying a pressurized fluid therebetween, a resilient sealing means located in said first chamber means, said resilient sealing means being movable outwardly by centrifugal force to restrict pressurized flow through said radial opening means, said first chamber means having side walls spaced apart to allow pressurized fluid to flow unrestricted by said resilient sealing means until said resilient sealing means has been moved outwardly by centrifugal force to restrict pressurized flow through said radial opening means, said inner surface of said first wall forming a contoured surface extending between said side walls, said contoured surface having a groove extending across said inner surface between said side walls in line with said radial opening means.

20. A speed governed rotary device comprising a turbine rotor having an axis of rotation, means for mounting said turbine rotor for rotation about said axis of rotation, said turbine rotor having a first radially extending chamber means therein, means for directing a pressurized fluid into said first radially extending chamber means, said turbine rotor having a second chamber means located radially outwardly of said first chamber means, a first wall being located between said first chamber means and said second chamber means, said second chamber means having an outer second wall, nozzle means in said outer second wall connecting said second chamber means to the exterior of said outer second wall for directing a pressurized fluid therefrom to impart rotation of said turbine rotor, said first wall having radial opening means therein connecting said first chamber means to said second chamber means for carrying a pressurized fluid therebetween, a resilient sealing means located in said first chamber means, said resilient sealing means being movable outwardly by centrifugal force to restrict pressurized flow through said radial opening means, said radial opening means includes a plurality of radial openings extending through said first wall between said first chamber means and said second chamber means, means for restraining movement of said resilient sealing means outwardly towards the ends of said radial openings, said first chamber means having side walls spaced apart, the inner surface of said first wall forming a contoured surface extending between said side walls, said means for restraining movement of said resilient sealing means outwardly having a groove extending across said inner surface between said side walls in line with each radial opening.

21. A centrifugally operated valve structure comprising a rotatable enclosure, said enclosure having a fluid pressure inlet means and fluid pressure outlet means for conducting fluid through said enclosure forming a pressure fluid flow passage means, resilient sealing means disposed in conjuntion with and rotatable with said pressure fluid flow passage means, surface means located radially outward of said resilient sealing means for engagement by said sealing means, said resilient sealing means being movable outwardly by centrifugal force to restrict pressurized flow through said fluid pressure outlet means, said sealing means being operable by centrifugal force to elastically deform its configuration by being forced radially against said radially outward surface means to restrict or close fluid flow through said fluid pressure outlet means, said radially outward surface means providing for positioning all of said resilient sealing means radially during operation after initial contact of said radially outward surface means by said resilient sealing means.

22. A combination as set forth in claim 21 wherein said fluid pressure outlet means is a plurality of holes in said rotatable enclosure extending outward.

23. A combination as set forth in claim 21 wherein said sealing means is an annular member constructed of resilient material.

24. A combination as set forth in claim 21 wherein said surface means is constructed so as to control the shape of said sealing means deformation for sealing.

25. A combination as set forth in claim 21 wherein a fluid pressure motor is connected to rotate with said rotatable enclosure, said fluid pressure outlet supplying pressure fluid to said fluid pressure motor thereby functioning as a governing device.

26. A combination as set forth in claim 21 wherein said pressure fluid passage is a pluraity of holes extending radially outward, said sealing means is an annular member constructed of rubber-like material, said restraining means is constructed so as to control the shape of said sealing means deformation, and said rotatable enclosure is connected to rotary motion of a fluid pressure motor through which said pressure fluid passes thereby functioning as a governing device to control rotary speed.

27. A combination as set forth in claim 26 wherein said surface means includes contoured means at the inner end of a plurality of each of said holes to control the deformation of said sealing means for restricting fluid flow through said holes.

28. A combination as set forth in claim 21 wherein the structure of said enclosure and said resilient sealing means maintains the location of said sealing means in an operating position to control flow through said fluid pressure outlet means even though said resilient sealing means is broken through.

29. A combination as set forth in claim 28 wherein said resilient sealing means is annular, the structure of said enclosure and said annular sealing means maintains the location of said annular sealing means to control flow through said fluid pressure outlet means even though said annular sealing means has a break therein.

30. A combination as set forth in claim 21 wherein said fluid pressure outlet means includes opening means extending through said enclosure, said sealing means being positioned against said enclosure, said resilient sealing means having opening means therethrough aligned with said opening means through said enclosure, said resilient sealing means when moved outwardly by centrifugal force deforms the sealing means to restrict flow through said opening means of said enclosure.

31. A combination as set forth in claim 30 wherein said opening means includes a plurality of openings extending through said enclosure, said resilient sealing means being annular, said annular resilient sealing means including a plurality of openings extending therethrough aligned with said openings in said enclosure, said annular resilient sealing means when moved outwardly by centrifugal force deforms the annular sealing means to restrict flow through said openings of said enclosure.

32. A combination as set forth in claim 31 wherein said openings in said enclosure extend in a radial direction.

33. A combination as set forth in claim 21 wherein said resilient sealing means is not fixedly connected to said enclosure.

34. A combination as set forth in claim 21 wherein said fluid pressure outlet means is a plurality of holes spaced around said rotatable enclosure extending outwardly, said resilient sealing means being an annular member of resilient material, said resilient annular member being located radially inward of said plurality of holes, a separate contoured surface means for each hole so as to control the shape of said annular member of resilient material for controlling flow to each hole.

* * * * *